United States Patent [19]

Gresens

[11] Patent Number: 4,899,427

[45] Date of Patent: Feb. 13, 1990

[54] TENSIONING MACHINE FOR THE HEAT TREATMENT OF TEXTILE FABRIC

[75] Inventor: Harry Gresens, Benningen/Neckar, Fed. Rep. of Germany

[73] Assignee: Bruckner Trockentechnik GmbH & Co. KG, Leonberg, Fed. Rep. of Germany

[21] Appl. No.: 170,984

[22] Filed: Mar. 21, 1988

[30] Foreign Application Priority Data

May 26, 1987 [DE] Fed. Rep. of Germany ..... 3717774

[51] Int. Cl.[4] ..... D06C 3/02

[52] U.S. Cl. ..... 26/92

[58] Field of Search ..... 26/91, 92, 93

[56] References Cited

U.S. PATENT DOCUMENTS 3,303,528 2/1967 Gageur et al. ..... 26/91
3,327,367 6/1967 Dungler ..... 26/92 X
4,559,680 12/1985 Gresens ..... 26/91 X

FOREIGN PATENT DOCUMENTS 971737 10/1964 United Kingdom ..... 26/93
2178077 2/1987 United Kingdom ..... 26/92

*Primary Examiner*—Werner H. Schroeder
*Attorney, Agent, or Firm*—Sheldon & Mak

[57] ABSTRACT

The tensioning machine serves for a heat treatment of lengths of material which are guided widthways, particularly textile material. Two tensioning chains convey the lengths of material in the usual way through an inlet zone, a plurality of heat treatment zones and an outlet zone, and the advancing and returning strands of the tensioning chain are supported and guided in chain guide rails. In order to cool the tensioning chains very effectively and thereby to be able to prolong the operational life of the high-temperature grease which is used, cooling air blowing arrangements by which the used cooling air can be introduced into the heat treatment zones as preheated fresh air are associated with the long sections of the chain guide rails running inside the heat treatment zones.

5 Claims, 3 Drawing Sheets

TENSIONING MACHINE FOR THE HEAT TREATMENT OF TEXTILE FABRIC

BACKGROUND

The invention relates to a tensioning machine for the heat treatment of lengths of material which are guided widthways, particularly lengths of textile material.

In tensioning machines, particularly the more modern tensioning machines, the tensioning chains intended to convey the lengths of material through the machine frequently travel around at relatively high speeds and are also subjected to relatively high treatment temperatures. The links of these tensioning chains are provided at their joints with so-called high-temperature grease, but the operational life thereof depends not only upon the chain stress but also to a considerable extent upon the temperature stress which derives from the prevailing chain temperature.

Attempts have therefore been made to keep the chain temperature as low as possible in order thereby to increase the operational life of the high-temperature grease which is used. Thus for example it has already been proposed for this purpose inter alia (cf. German Patent document DE-OS 35 26 584) to associate cooling air blowing arrangements with the chain guide rails of a tensioning machine in the long sections located in the region of the material inlet zone and/or the material outlet zone. In this way, cold air should be blown onto the sections of the tensioning chain running above all in the region outside the heat treatment zones so that these sections of the chain are cooled to some extent thereby. However, when this known construction of a tensioning machine is put into practice the tensioning chain only cools by a relatively small amount (for example by relatively few °C.), which does not lead to any effective lengthening of the operational life of the high-temperature grease usually used in tensioning chains, and a disadvantage of this is that the expected operational life is a function of the operating temperature of the grease.

As a further disadvantage of the known tensioning machine, it should also be mentioned that in it the strands of the tensioning chain running forwards and backwards have cooling air blown onto them from below, i.e. through bores provided in the bearing surfaces. The structural work necessary for this in the region of the chain guide rails involve considerable additional expense.

SUMMARY OF THE INVENTION

The object of the invention, therefore, is to provide a tensioning machine which is distinguished by particularly effective cooling of the tensioning chains with relatively low expenditure on construction.

In contrast to the known construction described in the introduction, in the tensioning machine according to the invention, the cooling air blowing arrangements are only arranged approximately on the length of the long sections of the chain guide rails running inside the material treatment zones. This means in practice that at least on the returning strand of the tensioning chain, the cooling air is blown onto a length which is considerably greater than the length of the inlet and outlet zones. By this means alone a considerably more effective and greater degree of cooling of the tensioning chains is brought about by comparison with the known constructions, so that a clearly perceptible increase in the operational life of the high-temperature grease used can be achieved by this construction according to the invention.

A further advantage of the construction according to the invention is clear from the following situation: In the known tensioning machine described above, the cooling air is taken from the space surrounding the tensioning machine, blown onto the tensioning chains (in the region of the inlet and/or outlet zone) and then returned to the surrounding space. With the levels of heat stress which are already high in a textile finishing plant, this is a very unpleasant and undesirable accompanying phenomenon. Since by contrast in the tensioning machine according to the invention the cooling air is blown onto the tensioning chains only in the region inside the heat treatment zones and the used cooling air can be introduced as preheated fresh air into the heat treatment zones, in this construction there are no undesirable burdens on space (with correspondingly heated exhaust air from the chain cooling process) and no heat losses. The heat removed from the tensioning chains when they are cooled is thus put indirectly to good use by being delivered as fresh air to the heat treatment process inside the tensioning machine, so that the tensioning machine can be made correspondingly more economical.

In tensioning machines, it should also be noted in general that most of the material conveying and chain service assemblies are provided in the region of the tensioning chains and chain guide rails which are located on the exterior (outside the heat treatment zones), and thus for this reason these regions appear unsuitable for the mounting of any additional equipment, such as cooling air blowing arrangements. By contrast, in the present invention, the cooling air blowing arrangements are arranged in the interior of the heat treatment zones where they cannot affect the assemblies referred to above and thus for this reason alone the overall construction and the maintenance of the tensioning machine are much more useful.

DRAWINGS

The invention will be explained in greater detail below with the aid of the drawings, in which.

DETAILED DESCRIPTION

Figure 1:
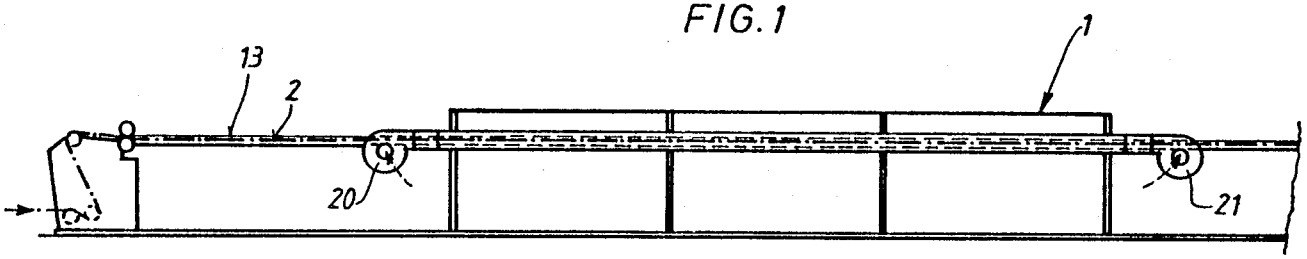
FIG. 1 shows a quite schematic (partial) side view of a tensioning machine according to the invention.
Figure 2:
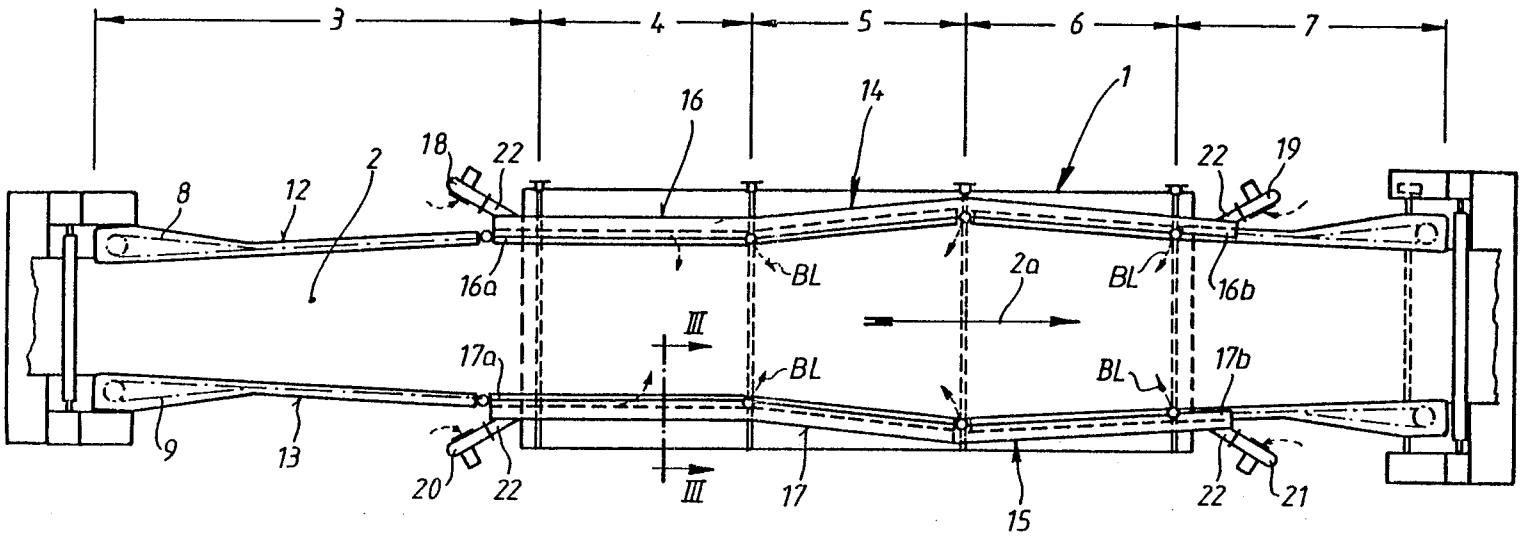
FIG. 2 shows a simplified schematic plan view of the tensioning machine according to the invention, (with the heat treatment zones uncovered.

First of all, the general construction of the tensioning machine 1 according to the invention will be explained with the aid of FIGS. 1 and 2. The tensioning machine 1 serves for the heat treatment. e.g. drying and/or fixing, of lengths of material 2 which are guided widthways (cf. FIG. 2) which can in particular be lengths of textile material.

The tensioning machine 1 is divided in its longitudinal direction into a plurality of successive zones so that it contains—in succession in the direction of the material transport (arrow 2*a*)—a material inlet zone 3, three heat treatment zones 4, 5 and 6 and a material outlet zone 7. Two tensioning chains 8 and 9, which are only indicated simply by dash-dot lines in FIGS. 1 and 2 are arranged so that they travel continuously around through all the zones 3 to 7 in the longitudinal direction of the tensioning machine, are an oblique distance apart. These tensioning chains 8, 9 can be constructed in the usual way and on chain links 10 (cf. also FIG. 3) they bear holding elements 11 which according to FIG. 3 can be constructed in the form of known grippers 11 or otherwise also in the form of needle plates or combined grippers in order to grip the two long edges of the lengths of material 2 to be treated while the material is being transported (on the advancing strand of the tensioning chains). The advancing and returning strands of both tensioning chains 8, 9 are guided in associated chain guide rails 12, 13 which are known per se.

The tensioning machine 1 also contains two cooling air blowing arrangements 14 and 15 which are each associated with a chain guide rail 12 or 13, respectively. According to the invention, these cooling air blowing arrangements 14, 15 are only arranged approximately on the length of the long sections of the chain guide rails 12, 13 which run inside the heat treatment zones 4, 5, 6. As can be seen from the detailed explanation with regard to FIG. 3, the arrangement and construction of the cooling air blowing arrangements 14, 15 is such that the used cooling air can be introduced into the heat treatment zones 4 to 6 as preheated fresh air.

Figure 3:
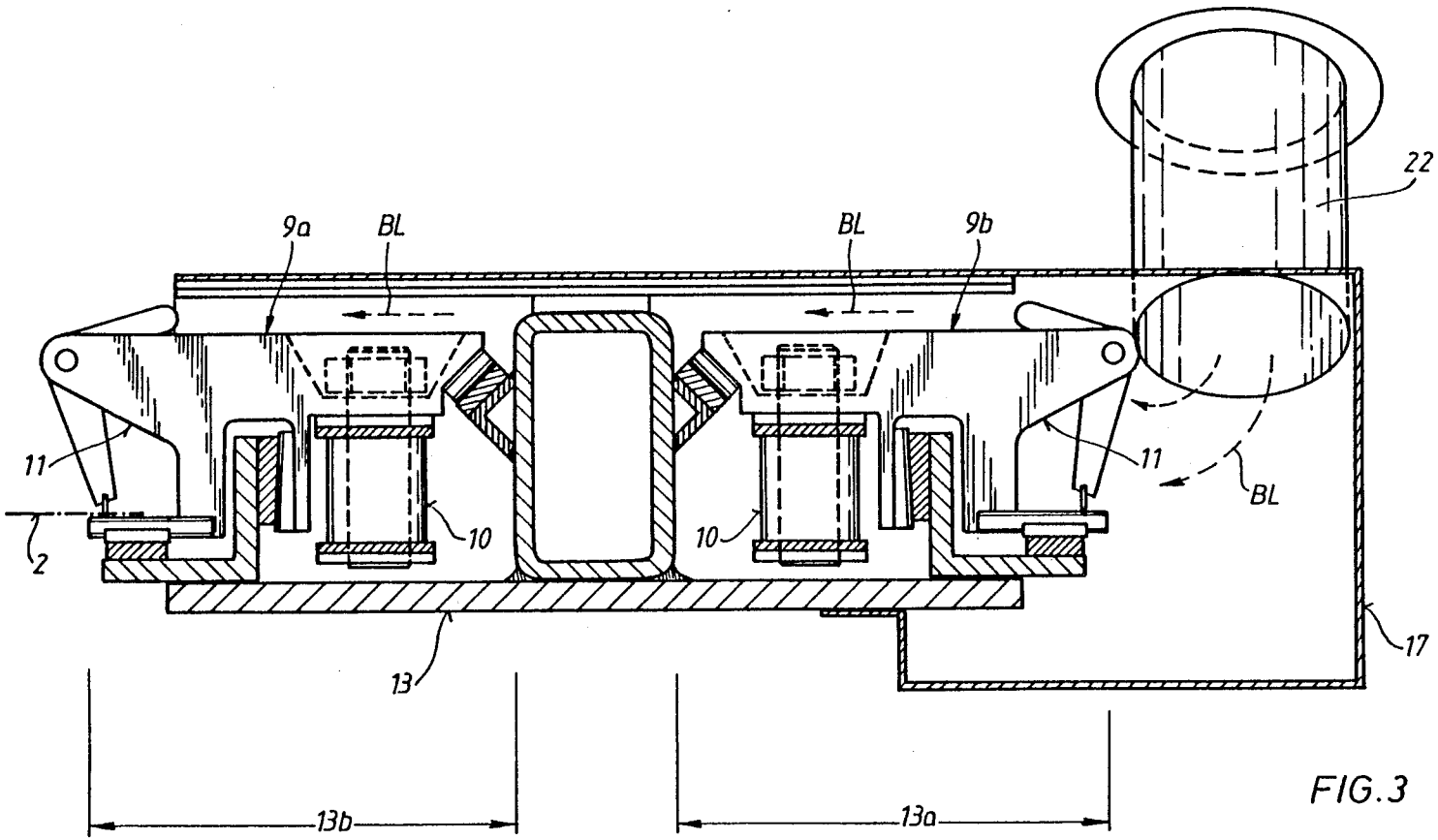
FIG. 3 shows a cross-sectional view approximately along the line III—III in FIG. 2, representing a cross-section through a chain guide rail (with tensioning chain) on an enlarged scale.

The construction and arrangement of the cooling air blowing arrangements 14, 15 is also such that the long sections of the chain guide rails running inside the heat treatment zones 4, 5, 6 are each enclosed at least in their regions constructed for the returning strand of the tensioning chain, e.g. 13*a* in FIG. 3, in a sheet metal channel 16, 17 serving as a cooling air guide channel, and these sheet metal channels 16, 17 can also extend in the transverse direction at least above the chain guide rails 12, 13 and thus have an open connection to the interior of the appertaining heat treatment zones, so that—as can be seen in particular from FIG. 3—the used cooling air (cf. arrows BL in FIGS. 2 and 3) pass through the inner regions, e.g. 13*b*, of the chain guide rails 12, 13 associated with the advancing strand of the tensioning chain and enter the heat treatment zones. Depending upon the total length of the tensioning machine 1 or of the heat treatment zones 4, 5, 6 and thus depending upon the length of the sheet metal channels 16, 17, at least one cooling air blower is connected to each sheet metal channel 16 or 17. In the case of FIGS. 1 and 2, it may be assumed that the total length of the heat treatment zones 4, 5, 6 is relatively great so that there are two cooling air blowers 18, 19 and 20, 21, respectively, associated with each sheet metal channel 16, 17. A cooling air pipe connection 22 (cf. also FIG. 3) which is connected in each case to the delivery side of the appertaining (separate) cooling air blower 18 to 21 is fixed at each end 16*a*, 16*b* and 17*a*, 17*b*, respectively, of each sheet metal channel 16, 17. In this way, with long tensioning machines, cooling air can be blown in at both ends of the sheet metal channels 16, 17, approximately 50% of the total cooling air being advantageously blown in in each case from the front end and the rear end of the corresponding sheet metal channel.

It goes without saying that in shorter tensioning machines only one end of each sheet metal channel is provided with a cooling air pipe connection which is connected to the delivery side of one single appertaining cooling air blower.

In general, each cooling air blower 18 to 21 can take cooling air from any suitable cooling air source. However, it has proved particularly advantageous if each cooling air blower 18 to 21 takes ambient air or air from around the tensioning machine 1. High-pressure fans are most suitable as cooling air blowers for the cooling air blowing arrangements 14, 15.

As can be seen from the cross-sectional view in FIG. 3, the chain guide rails 12, 13 are completely closed off towards the exterior in their long sections running inside the heat treatment zones 4, 5, 6—as far as the cooling air pipe connections 22. In this way, an extremely reliable delivery of the cooling air (cf. arrows in broken lines) into the sheet metal channels 16, 17 and from there directly onto the tensioning chains 8, 9 is achieved. FIG. 3 only shows a cross-section through the chain guide rail 13 and the tensioning chain 9 with its advancing and returning strands 9*a* and 9*b*; the other chain guide rail 12 and the appertaining tensioning chain 8 is constructed and arranged in a similar manner in mirror image.

In the tests on which the invention is based, temperature measurements were taken on the tensioning machine at different operating temperatures, i.e. at different temperatures of the air used for treatment on the tensioning chains and in particular on the chain grippers 11, and, as the following table shows, the temperature measurements on the chain grippers 11 were taken once without any cooling of the tensioning chain and once with cooling of the tensioning chain as well as at the tensioning machine inlet and also at the tensioning machine outlet.

TABLE

| Tensioning machine air temperature (°C.) | Gripper temperature (°C.) without cooling inlet | without cooling outlet | with cooling inlet | with cooling outlet |
|---|---|---|---|---|
| 120 | 85 | 85 | 52 | 52 |
| 150 | 98 | 114 | 59 | 68 |
| 180 | 122 | 126 | 68 | 72 |
| 220 | 148 | 158 | 82 | 86 |
| 250 | 162 | 172 | 88 | 92 |

The measured values set out in the table were obtained by contact measurement on the chain grippers.

The table shows very clearly that very effective cooling of the tensioning chains 8 and 9 can be achieved with the aid of the tensioning machine 1 constructed according to the invention, i.e. by the construction and arrangement according to the invention of the cooling air blowing arrangements 14 and 15. For example, if one compares the temperatures of the chain grippers at the inlet of the tensioning machine, then the temperature of the chain grippers in the tensioning machine at an air temperature (temperature of the air used for treatment) of 120° C. is 85° C. without cooling, whereas with the cooling according to the invention it is only 52° C. which makes a difference of 33° C. At the higher treatment air temperatures in the tensioning machine, these differences between chain grippers which are not specially cooled and chain grippers which are cooled according to the invention are much more marked: For example, at a treatment air temperature of 220° C., the chain grippers at the inlet are at 148° C. without cooling but only 82° C. with cooling according to the invention (that is to say a difference of 66° C.!)

Thus these temperature values set out in the table for the chain grippers at the different temperatures of the air used for treatment in the tensioning machine underline the particular effectiveness of the tensioning chain cooling according to the invention, so that the operational life of the high-temperature grease used in the tensioning chain links can be lengthened considerably with improved efficiency of the tensioning machine and relatively simple construction of the cooling air blowing arrangements 14, 15.

Figure 4:
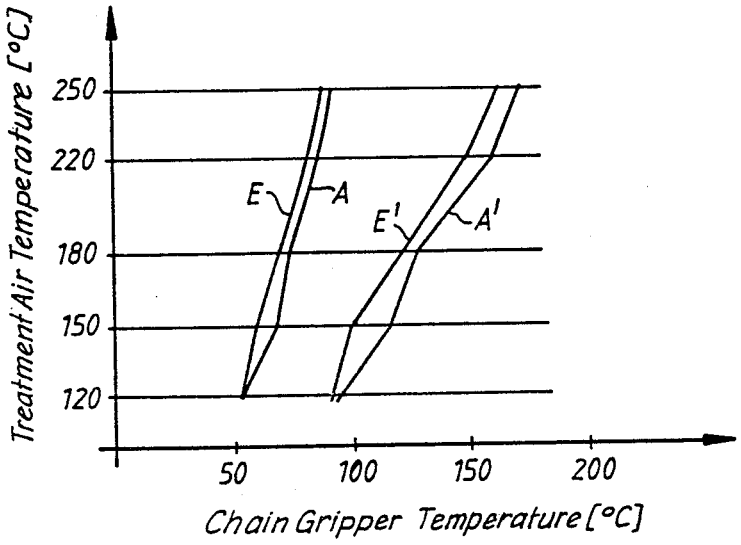
FIG. 4 shows a temperature diagram for comparison of cooled and uncooled grippers at different air temperatures in the tensioning machine.

The marked reduction in temperature of the chain grippers as a result of the cooling according to the invention which is explained above with the aid of the table can also be read off from the temperature diagram in FIG. 4. In this diagram, the different values for the temperature of the air used for treatment (in °C.) inside the tensioning machine 1 are plotted in the ordinate and the chain gripper temperature values (also in °C.) obtained by contact measurement are plotted in the abscissa. In the curves reproduced in this diagram according to FIG. 4, the curve E shows the temperature values of the chain grippers at the tensioning machine inlet and the curve A shows the temperature values of the chain grippers at the tensioning machine outlet, in each case, in tensioning chains 8, 9 which have been cooled according to the invention, whereas the curves E′ and A′ show the temperature values for the chain grippers in uncooled tensioning chains.

I claim:

1. A tensioning machine for the heat treatment of lengths of material which are guided widthways, in particular lengths of textile material, comprising:

(a) an elongated heating chamber having a longitudinal axis comprising:

(i) a first sidewall, a second opposite sidewall, a top wall and a bottom wall, each wall being disposed in parallel to the longitudinal axis of the chamber;

(ii) an inlet opening and an oppositely disposed outlet opening, both openings being transverse to the longitudinal axis of the chamber; and (iii) means for heating air within the chamber;

(b) a tensioning chain assembly comprising:

(i) a first tensioning chain drawn tightly around a pair of opposing rotatable seaves, both seaves being disposed outside of the heating chamber with one seave disposed proximate to the inlet opening and the other seave being disposed proximate to the outlet opening, the first tensioning chain being thereby disposed proximate to the first side wall of the heating chamber in a continuous rotatable loop having an advancing strand moiety and a returning strand moiety;

(ii) a second tensioning chain drawn tightly around a pair of opposing rotatable seaves, both seaves being disposed outside of the heating chamber with one side disposed proximate to the inlet opening and the other seave being disposed proximate to the outlet opening, the second tensioning chain being thereby disposed proximate to the second side wall of the heating chamber in a continuous rotatable loop having an advancing strand moiety and a returning strand moiety;

(iii) holding elements attached to both the first tensioning chain and the second tensioning chain disposed protruding away from the advancing strand moieties of each tensioning chain in a direction towards the longitudinal axis of the heating chamber and adapted for gripping the edge of a length of cloth; and (iv) means for rotating both the first tensioning chain and the second tensioning chain about their respective chain and the second tensioning chain about their respective opposing seaves so that the advancing strand moiety of each tensioning chain travels in a direction from the inlet opening towards the outlet opening;

(c) a first returning strand housing which encloses that portion of the first returning strand moiety within the heating chamber, the first returning strand housing having oppositely disposed open ends for the ingress and egress of the returning strand moiety of the first tensioning chain;

(d) a second returning strand housing which encloses that portion of the second returning strand moiety within the heating chamber, the second returning strand housing having oppositely disposed open ends for the ingress and egress of the returning strand moiety of the second tensioning chain;

(e) a first advancing strand housing which partially encloses that portion of the first advancing strand moiety within the heating chamber, the first advancing strand housing comprising walls which define a continuous advancing strand housing lateral opening which is parallel with and facing the longitudinal axis of the heating chamber, the first advancing strand housing being in fluid communication with the first returning strand housing, and the first advancing strand housing having oppositely disposed open ends for the ingress and egress of the advancing strand moiety of the first tensioning chain;

(f) a second advancing strand housing which partially encloses that portion of the second advancing strand moiety within the heating chamber, the second advancing strand housing comprising walls which define a continuous advancing strand housing lateral opening which is parallel with and facing the longitudinal axis of the heating chamber, the second advancing strand housing being in fluid communication with the second returning strand housing, and second advancing strand housing having oppositely disposed open ends for the ingress and egress of the advancing strand moiety of the second tensioning chain;

(g) means for blowing air into at least one end of each of the returning strand housings; whereby a length of material can be stretched between the two advancing strand moieties by attachment to the respective tensioning chain holding elements and drawn through the heating chamber from the inlet opening to the outlet opening so that the length of material can be heated by hot air within the heating chamber, and whereby air can be caused to flow into at least one end of each of the returning strand housings so as to cool the returning strand moieties, whereby such air can thereafter be caused to flow from each returning strand housing into one of the advancing strand housings so as to cool the advancing strand moiety and whereby such air can thereafter be caused to flow from each advancing strand housing via the continuous lateral opening into the heating chamber so as to provide the heating chamber with preheated air.

2. The tensioning machine of claim 1 wherein the means for blowing air comprises an air blower the delivery side of which is in fluid communication with at least one end of both returning strand housings.

3. The tensioning machine of claim 1 wherein the means for blowing air comprises an air blower the delivery side of which is connected in fluid communication with both ends of both returning strand housings.

4. The tensioning machine of claim 1 wherein the returning strand housings are constructed of sheet metal.

5. The tensioning machine of claim 2 wherein the air blower is disposed in such a way that the suction side of the air blower draws air from an air source at ambient temperature.

* * * * *